US011450997B1

(12) United States Patent
Insalaco

(10) Patent No.: US 11,450,997 B1
(45) Date of Patent: Sep. 20, 2022

(54) FUNCTIONAL INDOOR ELECTRICAL WALL OUTLET COVER

(71) Applicant: Socket Solutions, LLC, Houston, TX (US)

(72) Inventor: Michael George Insalaco, Houston, TX (US)

(73) Assignee: Socket Solutions, LLC, Houston, TX (US)

( * ) Notice: Subject to any disclaimer, the term of this patent is extended or adjusted under 35 U.S.C. 154(b) by 20 days.

(21) Appl. No.: 17/175,604

(22) Filed: Feb. 12, 2021

(51) Int. Cl.

| | |
|---|---|
| ***H01R 9/11*** | (2006.01) |
| ***H01R 25/00*** | (2006.01) |
| *H01R 13/512* | (2006.01) |
| *H01R 13/504* | (2006.01) |

(52) U.S. Cl.
CPC ..... *H01R 25/003* (2013.01); *H01R 13/504* (2013.01); *H01R 13/512* (2013.01)

(58) Field of Classification Search
CPC ... H01R 13/504; H01R 13/512; H01R 25/003
USPC ..... 439/623
See application file for complete search history.

(56) References Cited

U.S. PATENT DOCUMENTS

| | | | | |
|---|---|---|---|---|
| 3,714,616 A | | 1/1973 | Sample | |
| 4,043,629 A | | 8/1977 | Brannen | |
| 4,451,108 A | | 5/1984 | Skidmore | |
| 4,797,507 A | | 1/1989 | Lefving | |
| 5,002,502 A | | 3/1991 | Hill | |
| 5,004,435 A | * | 4/1991 | Jammet | H01R 25/006 439/652 |
| 5,094,630 A | | 3/1992 | Jammet | |
| 5,375,728 A | * | 12/1994 | West | H01R 13/443 174/67 |
| 5,401,184 A | * | 3/1995 | Sundstrom | H01R 13/6392 174/67 |
| 5,542,852 A | | 8/1996 | Hush | |
| 5,723,816 A | * | 3/1998 | Neece | H02G 3/14 174/67 |
| 6,703,562 B1 | | 3/2004 | Pacheco | |
| 6,897,381 B2 | * | 5/2005 | He | H01R 31/06 33/528 |
| 6,977,342 B1 | * | 12/2005 | Maltby | H02G 3/14 174/67 |
| 7,229,322 B2 | | 6/2007 | Bangert | |

(Continued)

*Primary Examiner* — Abdullah A Riyami
*Assistant Examiner* — Vladimir Imas
(74) *Attorney, Agent, or Firm* — Karen B. Tripp

(57) ABSTRACT

An indoor electrical wall outlet cover permitting full functional use of a two-plug or duplex electrical wall outlet while fully concealing the plug contact openings of the outlet. The cover has two functional electrical plugs that insert respectively into the two receptacles in the outlet and are respectively connected to two extended electrical cords having at their distal ends one or more functional electrical receptacles or a direct connection to a small appliance or electronic device for indirect use of the wall outlet. The electrical cords can extend outward from the cover in the same or different directions and from the same or different sides of the cover. The functional electrical plugs have electrical connection pins that are bent at an angle enabling the cover to function without extending any significant degree outward of the wall outlet. In one embodiment, the cover can also hide the outlet from view.

22 Claims, 16 Drawing Sheets

(56) References Cited

U.S. PATENT DOCUMENTS

| | | | | |
|---|---|---|---|---|
| 7,690,942 | B2 * | 4/2010 | Berg | H01R 13/652 439/488 |
| 8,317,527 | B2 | 11/2012 | Vitale | |
| 8,905,780 | B2 | 12/2014 | Vallon | |
| 9,509,080 | B1 * | 11/2016 | Insalaco | H01R 24/30 |
| 9,525,232 | B1 | 12/2016 | Insalaco | |
| D776,064 | S | 1/2017 | Insalaco | |
| 10,305,216 | B1 * | 5/2019 | Shotey | H02G 3/12 |
| 10,516,240 | B1 * | 12/2019 | Insalaco | H01R 24/52 |
| 10,587,067 | B2 * | 3/2020 | Lager | H01R 13/443 |
| 11,271,351 | B1 * | 3/2022 | Chen | H01R 31/02 |
| 2014/0024247 | A1 | 1/2014 | Riesgaard | |
| 2014/0213104 | A1 * | 7/2014 | Hector, Jr. | H01R 24/30 439/573 |

* cited by examiner

FUNCTIONAL INDOOR ELECTRICAL WALL OUTLET COVER

CROSS REFERENCE TO RELATED APPLICATION

This application claims priority from U.S. Design patent application No. 29/765,912, filed Jan. 12, 2021, pending.

BACKGROUND OF THE INVENTION

1. Field of the Invention

The present invention relates to electrical connector devices. More particularly, the invention relates to indoor electrical outlets and indoor electrical outlet covers.

2. Description of Relevant Art

Electrical service in buildings, particularly in homes, offices, and schools, is typically provided at least in part through electrical wall outlets. Devices needing electrical current for operation or use have electrical cords ending in electrical plugs for connection to an electrical wall outlet. Once the plug is inserted into the wall outlet, electrical current can flow (or does flow if the wall outlet has electrical current flowing into it) to the cord for activating the device needing current.

Most typically, when a plug with a cord is connected to an electrical wall outlet, the plug and cord extend several inches from the wall outlet before the cord curves to a parallel posture with respect to the wall. As a consequence, furniture or other items positioned adjacent to the wall must be positioned sufficiently away from the wall outlet to accommodate the plug and cord connection to the wall outlet and also to accommodate someone's hand and often times arm in reaching behind the furniture to insert the plug into the wall outlet. Such positioning wastes space in the room and is generally unattractive.

Moreover, typically and commonly used electrical wall outlets are themselves generally unattractive and are known to pose a potential safety hazard for infants and children. Blank cover plates and individual non-conductive plugs are commonly used to prevent children from inserting objects into wall outlet receptacles and getting shocked and injured thereby, but such plates and plugs then prevent use of the outlets.

U.S. Pat. No. 9,509,080, issued Nov. 29, 2016, to Insalaco, teaches an electrically functional indoor wall outlet cover that solves a number of these problems. It is thin enough to allow furniture placement adjacent a wall in front of the outlet and it is able to hide the outlet altogether while allowing the electrical functionality of the outlet to be moved by an electrical cord. However, that functional electrical wall outlet cover is designed to effectively access electrical current from only one receptacle, particularly the top receptacle, and thus the second receptacle, particularly the bottom receptacle, in a duplex or one-gang electrical wall outlet is not accessed. Thus there continues to be a need in the art for electrical wall outlets and electrical wall outlet covers that overcome the shortcomings presented above.

SUMMARY OF THE INVENTION

The present invention provides an indoor electrical wall outlet cover that solves the problems associated with indoor outlet covers and allows full access of electrical current from, and use of, both the top receptacle and the bottom receptacle of a duplex or one-gang electrical wall outlet. The back of the wall outlet cover of the apparatus of the present invention has extending outwardly from the back of it a first electrical plug which connects directly to said top receptacle and a second electrical plug which connects directly connected to said bottom receptacle. A first electrical cord extends from the first electrical plug and a second electrical cord extends from the second electrical plug. The first electrical cord and the second electrical cord each exit from a side of the cover and separately end a desired distance away with the distal end of each first electrical cord and second electrical cord having at least one receptacle or one of said cords having a distal end prepared for connection to a small appliance or electronic device. These distal ends of said electrical cords can be positioned in opposite directions or at perpendicular angles to each other or in opposite ends of the same room and afford enhanced versatility to the apparatus of the invention.

The present invention further provides an indoor electrical wall outlet cover that is thin enough to avoid adding bulk to the outlet and thus enables furniture to effectively be positioned against the wall or at least as close as the baseboard on the wall, that also effectively covers the outlet so as to act as a safety device for a child that may seek to touch or access the outlet receptacles, and that still allows ready access to the dual electrical connections that the two plug outlet affords.

Moreover, the outlet cover is aesthetically pleasing—it is unobtrusive and calls less attention to itself than does the outlet without the cover of the invention. This is because the outlet cover, at least in one embodiment, is essentially or substantially blank, hides the receptacles of the outlet completely, and results in the two electrical cords extending from the outlet and that extension is in a manner where the cords lie against the wall or along the wall or less than about an inch from the wall, at least when proximate the outlet.

BRIEF DESCRIPTION OF THE DRAWINGS

The present invention will be better understood by referring to the following detailed description of preferred embodiments and the drawings referenced therein, in which.

REFERENCE NUMERALS IN THE DRAWINGS

Figure 1:
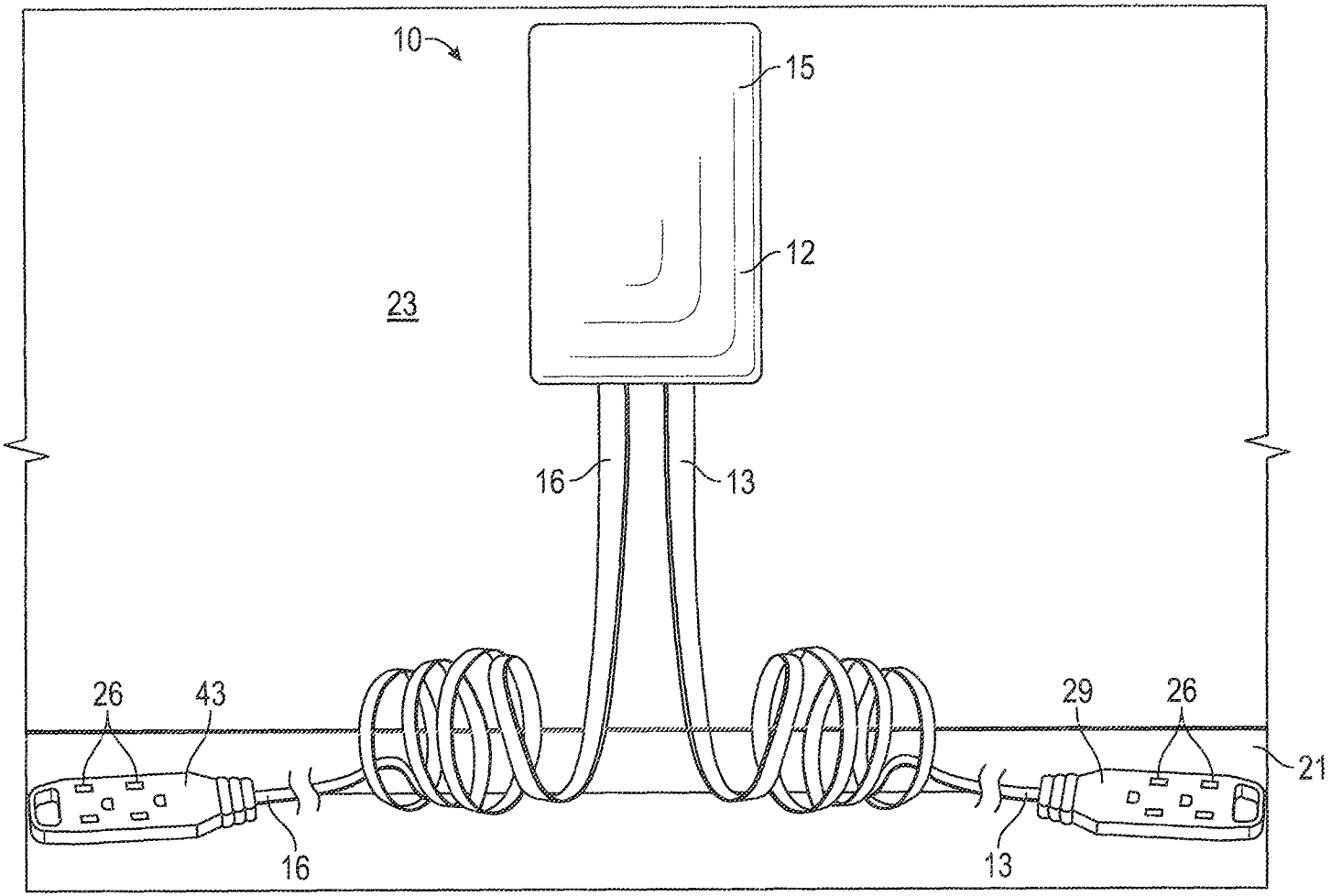
FIG. 1 is a front side perspective view (for illustration and not drawn to scale) of one embodiment of the apparatus of the invention, where first and second electrical cords respectively from first and second separate electrical connection components respectively in the first receptacle and second receptacle of the electrical duplex wall outlet, extend from the lower end of the cover plate, as shown in place on an electrical duplex wall outlet as it might typically be used.

10 one embodiment of the apparatus of the invention
11 indoor electrical duplex wall outlet
12 frontplate component of cover of apparatus of invention
13 first electrical cord
14 backplate component of cover of apparatus of invention
14*a* alternative backplate component
15 cover of apparatus of the invention
16 second electrical cord
17 first hot electrical pin, of first electrical component
18 second hot electrical pin, of second electrical component
19 second ground wire, of second electrical component
20 second plug prong associated with electrical component 18
21 baseboard of interior wall 23

22 first ground plug prong
23 interior wall
26 electrical receptacle or socket
27 first neutral electrical pin, of first electrical component
28 second neutral electrical pin, of second electrical component
29 first ground wire, of first electrical component
30 second neutral plug prong associated with electrical component 28
31 third electrical contact of second receptacle 48 in wall outlet 11
33 fourth electrical contact of second receptacle 48 in wall outlet 11
35 electrical device
37 first hot plug prong, associated with first electrical pin
39 first neutral plug prong
41 first ground plug prong associated with ground wire 29
42 first contact in first receptacle 45 in wall outlet 11
43 receptacle at distal end of first or second electrical cord
44 second contact in first receptacle 45 in wall outlet 11
45 first receptacle in wall outlet 11
46 second electrical cord with alternative distal end prepared for direct connection to a small appliance or an electronic device
48 second receptacle in wall outlet 11
49 alternative distal end of alternative second electrical cord prepared for direct connection to a small appliance or electrical device
50 alternative embodiment of apparatus of invention with a first and second electrical cord having different distal ends, one being a receptacle and the other being prepared for direct connection to a small appliance or electrical device.

DETAILED DESCRIPTION OF PREFERRED EMBODIMENTS

The present invention provides for the indoor use of electricity through an indoor, thin, blank electrical wall outlet cover in a manner that fully conceals the underlying electrical wall outlet. This apparatus of the invention is particularly suited for double or duplex electrical outlets, that is, electrical outlets with two receptacles, for use with which the apparatus has two electrical plugs and two electrical cords extending respectively from the electrical plugs.

That is, the apparatus of the invention comprises two electrical plugs that directly and respectively connect to the two receptacles of the wall outlet. The proximal end of two electrical cords extend respectively from said two electrical plugs, past, through, or out of the wall outlet cover, such the distal end of at least of the two electrical cords ends with at least one receptacle a desired distance away from the wall outlet cover and the distal end of the other electrical cord also ends with at least one receptacle a desired distance away from the wall outlet cover or alternatively ends with preparation for direct connection to a small appliance or electronic device.

The present invention eliminates the traditional manner of connecting a visible electrical plug to a visible indoor electrical wall outlet in order to consume electricity through such electrical wall outlet. The present invention facilitates effective movement of the outlet to a different location and allows for each receptacle of a duplex outlet to be useable in a different location in the room.

The apparatus of the invention has the advantage of being able to direct the utility of the outlet in different or opposite directions from the outlet in a room. When the electrical cords extend from different sides of the outlet cover, such as for example, the top and bottom, or the bottom and a side, as shown in FIGS. 8, 9, and 13-16, such different directions can easily be guided by the direction the electrical cords extend from the outlet cover. Even when the two cords both extend from the same side, such as the bottom of the outlet cover for example as shown in the other FIGs, the electrical cords may be sent in different directions from the outlet cover to, for example, extend to two electrical devices at the opposite ends of a wall in a room having a duplex electrical wall outlet located between said electrical devices, as illustrated in FIGS. 1, 7, 17 and 18.

The outlet cover of the invention is also advantageous as a safety device that permits full functional use of a standard or typical indoor duplex electrical wall outlet while fully concealing the wall outlet and particularly concealing and shielding the openings or receptacles in the outlet from access by children. The apparatus of the invention obtains such safety advantage while being so thin as to avoid adding any significant bulk to the wall outlet, thereby enabling a user to position furniture in front of or adjacent to the outlet and essentially flush with, i.e., less than about an inch away from, the wall on which the outlet is located, or at least as close to the wall as any baseboard on the wall permits, and thereby providing another advantage of the invention.

Interior electrical wall outlets are points in an interior space of a building such as a home where electrical current can be run to power electrical devices such as appliances and electronics. The most common such outlets are 15-amp (and sometimes 20-amp) duplex receptacles, which are designed to accept standard plugs for most small appliances, such as toasters, blenders, and vacuum cleaners, electronics such as televisions and home theater systems as well as cellular phones and portable computing devices such as laptops and tablet computers, and lamps. The invention has utility with any such interior electrical wall outlets and the term "typical (or standard) indoor electrical wall outlet" herein is understood to refer to such duplex receptacle outlets (or duplex outlets) as well as similar outlets that have more receptacles, although duplex outlets are the primary focus of this invention.

Figure 2:
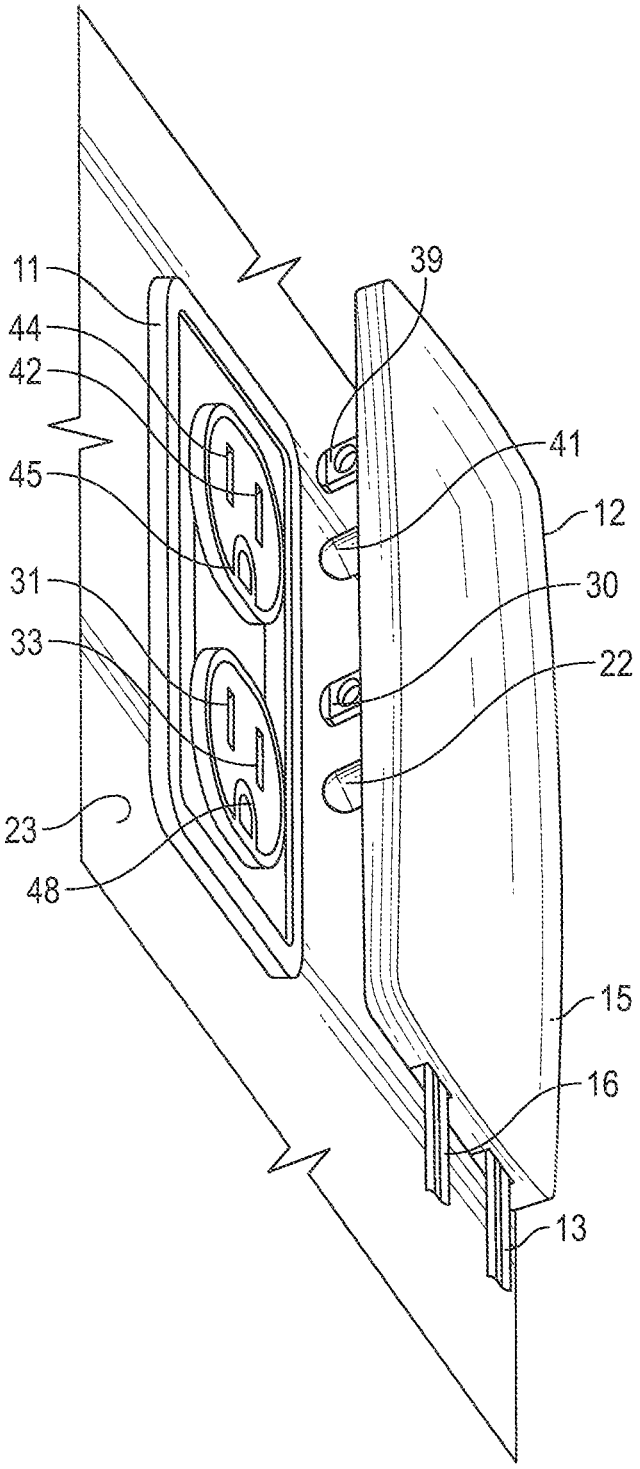
FIG. 2 is an enlarged front side perspective view of the embodiment of the apparatus of the invention of FIG. 1, just before it is placed over a typical electrical duplex wall outlet on a wall (for illustration and not drawn to scale).
Figure 4:
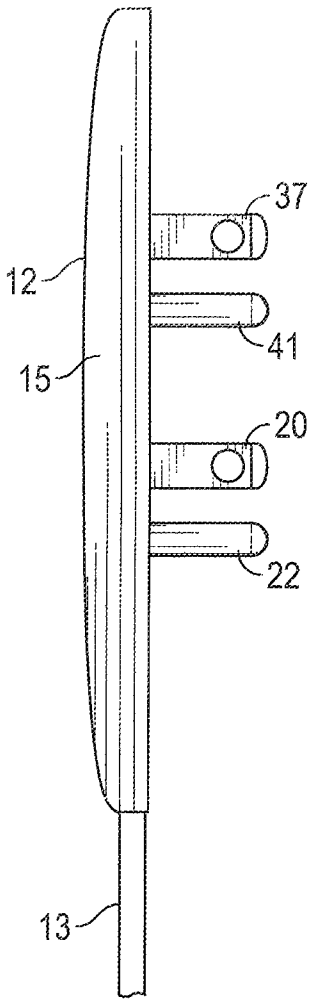
FIG. 4 is a side view of the embodiment of the apparatus of the invention of FIG. 1, showing the electrical pins as they extend out of the backplate.
Figure 8:
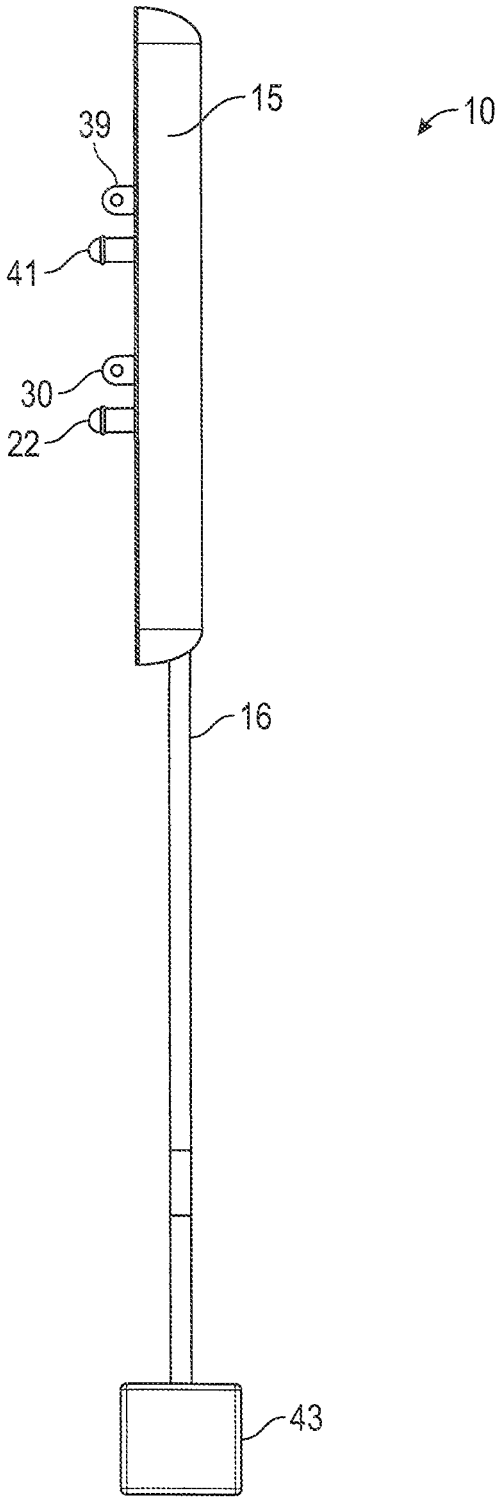
FIG. 8 is a side view of the embodiment of the apparatus of the invention of FIG. 1, showing the electrical pins as they extend out of the backplate of the apparatus and the electrical cords as they extend out of the ends of the apparatus.
Figure 9:
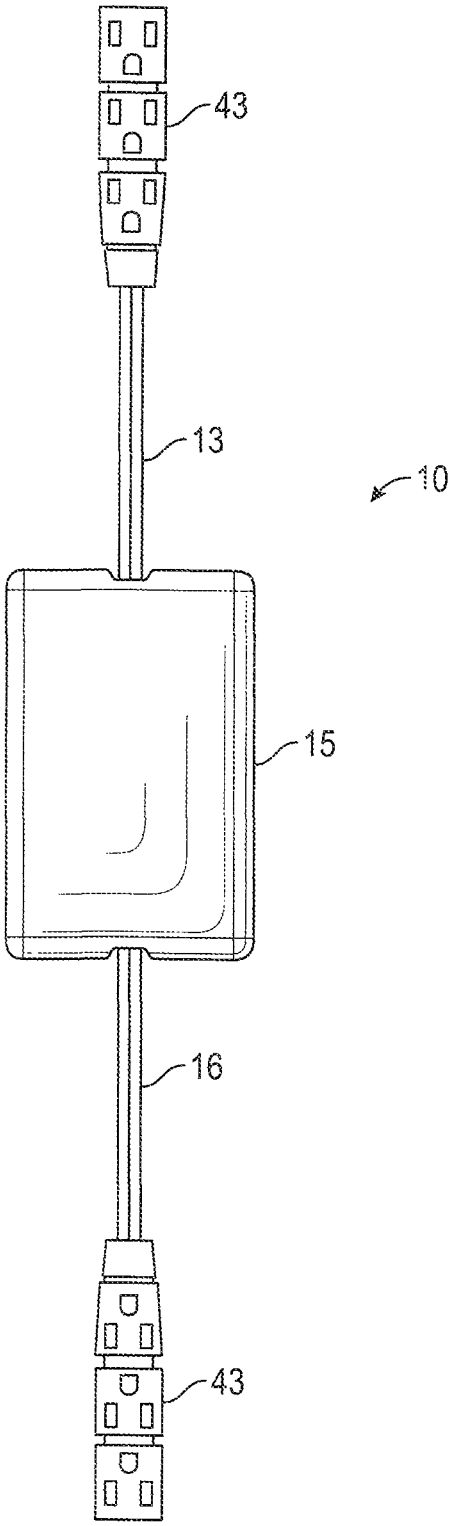
FIG. 9 is a front side perspective view (for illustration and not drawn to scale) of an alternative embodiment of the apparatus of the invention, where a third electrical cord from the third electrical connection component in the first or top receptacle of the duplex outlet extends from the upper or top end of the cover plate, and the fourth electrical cord from the fourth electrical connection component in the second or bottom receptacle of the duplex outlet extends from the lower or bottom end of the cover plate, as shown placed on an electrical duplex outlet on a wall as it might typically be used (for illustration and not drawn to scale).

Referring to FIG. 1, one embodiment of the apparatus 10 of the invention is shown in place over a typical indoor electrical duplex wall outlet 11 (not shown in FIG. 1 but shown in FIG. 2) on an interior wall 23. FIG. 2, showing the cover 15 of apparatus 10 just before placement over the electrical duplex wall outlet 11, and FIGS. 4 and 8, showing the sides of cover 15, indicate the thin, low profile of cover 15, particularly comprising frontplate component 12 mounted on backplate component 14. FIGS. 1 and 2 are drawn to illustrate features of the invention and are not drawn to scale. That is, cover 15 is drawn larger with respect to the remainder of the apparatus 10 and with respect to the wall outlet 11 than is actually contemplated to in fact occur with the embodiments of the invention as will be more fully explained below.

As used herein, the term "frontplate" with respect to the apparatus of the invention and particularly cover 15 means the faceplate or faceplate component of cover 15, and not the common faceplate of the wall outlet. The apparatus of the invention is used to hide the wall outlet 11 but no change or adjustment in the wall outlet 11 needs to be made. That is, the common faceplate of the wall outlet 11 does not need to be removed. To avoid any confusion between the common faceplate of a wall outlet and the faceplate of the cover of the apparatus of the invention, the faceplate component of the cover 15 of the apparatus 10 of the invention will be called herein the "frontplate."

The frontplate and backplate components of the invention are made of material that satisfies NEMA Standards or standards for UL safety certification. Such materials are characterized by resistance to chemicals, heat and impact, and typical applications include use in appliance housings and electronic and electrical assemblies. These materials include various plastics, including acrylonitrile butadiene styrene or ABS and polyvinyl chloride or PVC.

Figure 3:
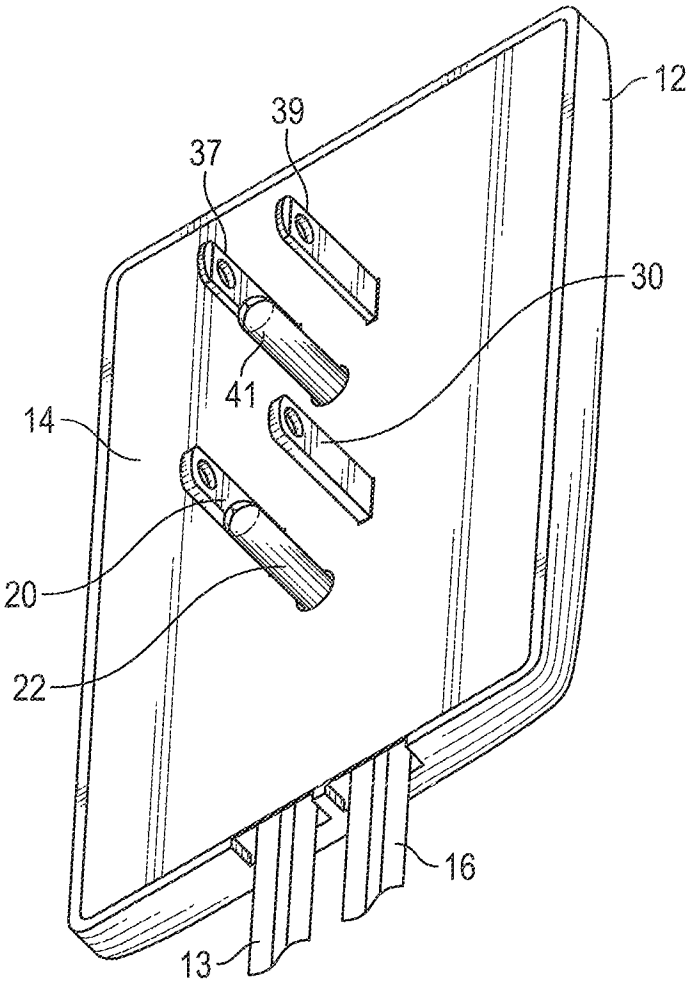
FIG. 3 is a back perspective view of the embodiment of the apparatus of the invention of FIG. 1.
Figure 7:
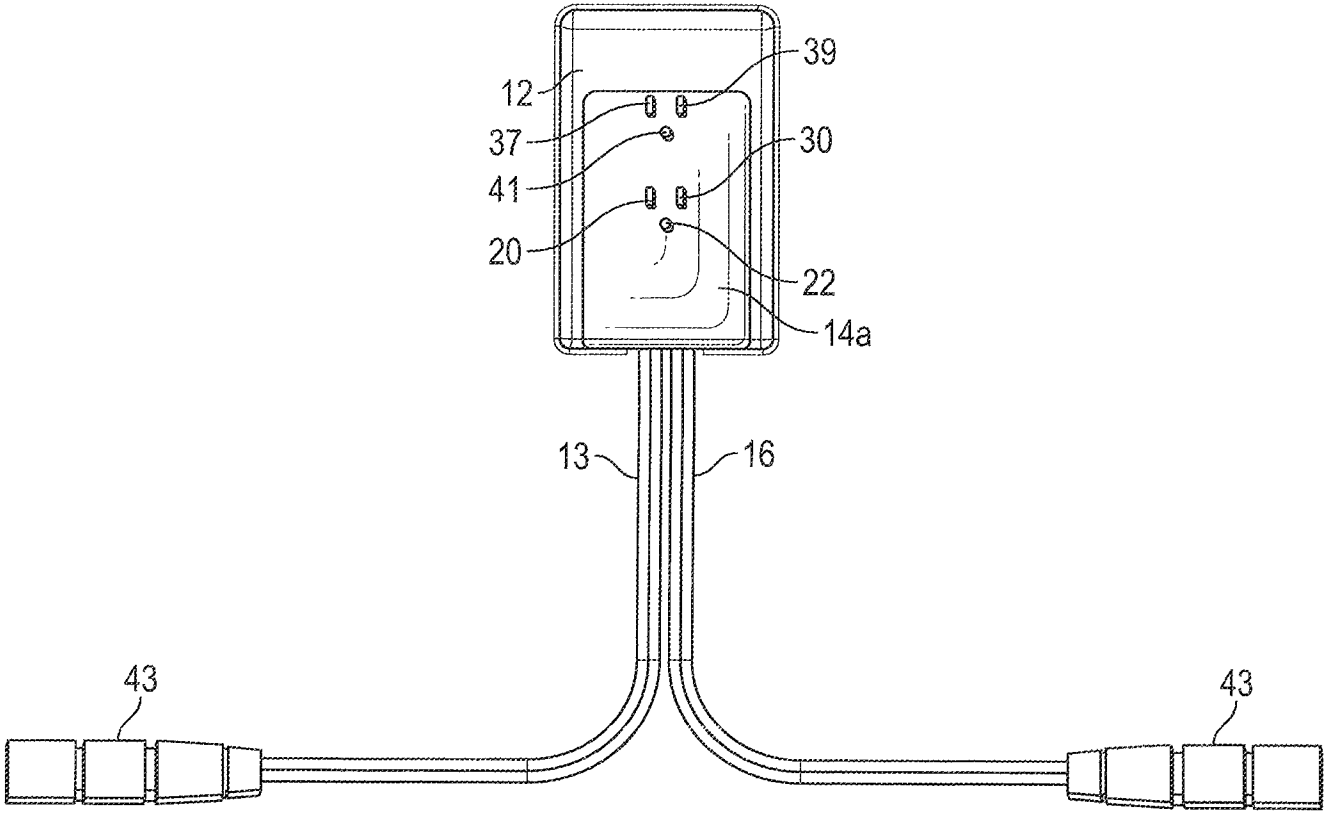
FIG. 7 is a back perspective view of the embodiment of the apparatus of the invention of FIG. 1 but with an alternative shaped backplate.

The maximum distance between the backplate component 14 and the frontplate component 12 is approximately the height or thickness of the electrical cords 16 connected to or attached to the backplate component 14, and this distance is only in the main body or central portion of the cover 15, as the outer or perimeter edges of the components 12 and 14 are proximate one another and touch or essentially touch, with the perimeter edge of backplate component 14 fitting inside the outer edge of frontplate component 12, as shown in FIG. 3. In one embodiment as shown in FIG. 7, the frontplate component 12 is sized to align and position over and encompass the entirety of the backplate component 14*a*, which is smaller than frontplate component 12. In an alternative embodiment such as shown in FIG. 3, the frontplate component 12 is sized to align and position over and preferably curve slightly around or up to the perimeter edge of the backplate component 14 for a tight fit—preferably tight enough to require no adhesive or screws to hold the components 12 and 14 together.

Figure 5:
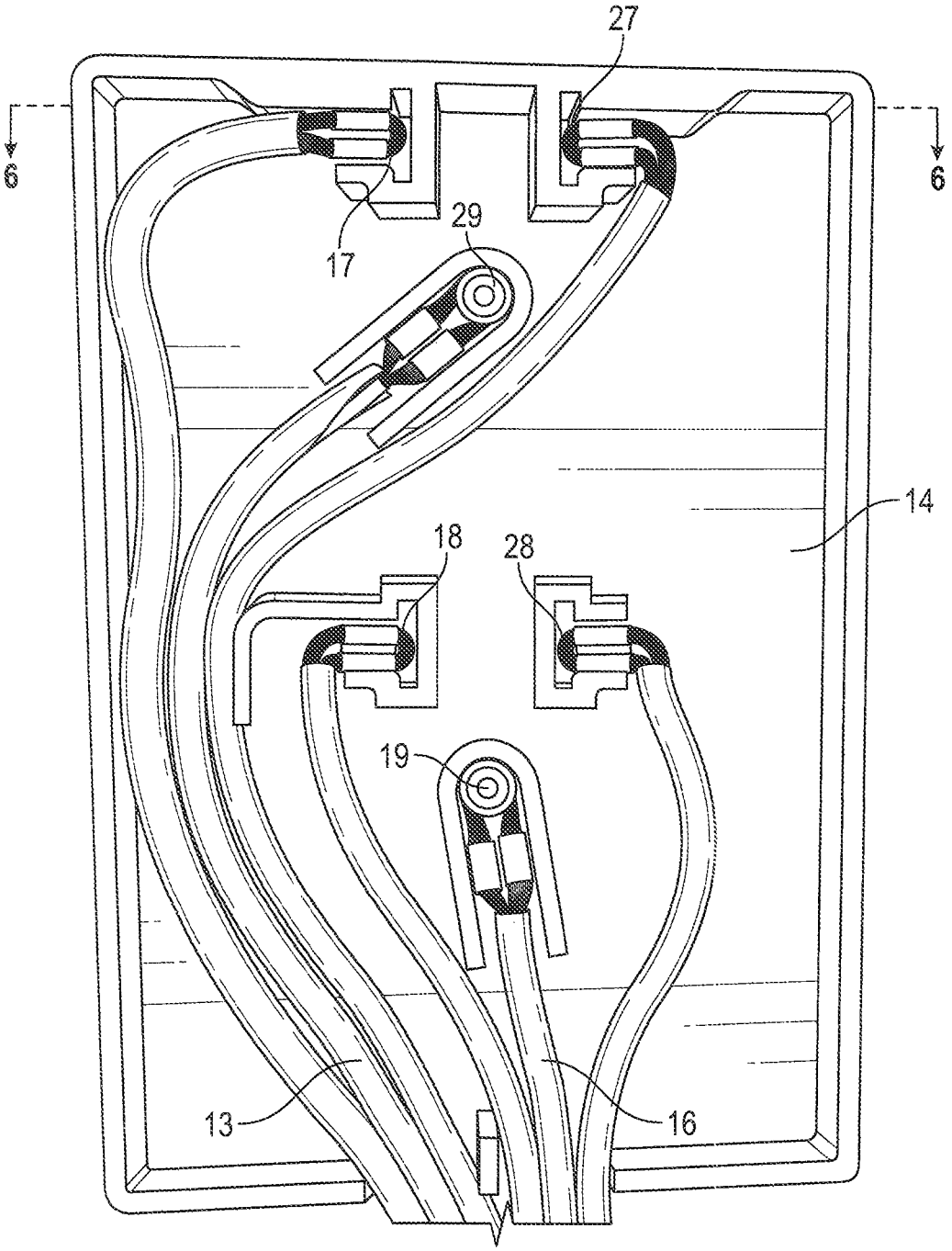
FIG. 5 is a view of the inside of the backplate of the embodiment of the apparatus of the invention of FIG. 1 showing the first electrical connection component and the second electrical connection component each having electrical pins bent at approximately ninety degree angles and mounted on the backplate with the electrical pins extending out of the front of the backplate.

Referring to FIG. 5, integral aspects of this embodiment of the apparatus 10 of the invention are the first electrical component of electrical pins 17 and 27, and ground wire 29, and the second electrical component of electrical pins 18 and 28, which are bent at approximately ninety degree angles with respect to the backplate component 14, and ground wire 19. These first and second electrical components are fastened to the backplate component 14, as shown in FIG. 5. In these aspects, the height of the horizontal portion of each electrical pin 17, 27, 18 and 28 and the ground wires 29, and 19 are approximately less or the same height (or thickness) as the respective first electrical cord 13 and second electrical cord 16, which are respectively attached to the first electrical component by attachment to the electrical pins 17, 27, and ground wire 29, and to the second electrical component by attachment to the electrical pins 18 and 28 and to ground wire 19. The first and second electrical cords 13 and 16 are also optionally attached to the backplate component 14.

A benefit of the electrical pins 17, 27, 18, and 28 and the ground wires 29 and 19 being bent at approximately ninety degree angles is that the depth of the cover 15, measured by the distance between the wall 23 when the cover 15 is inserted in the underlying electrical wall outlet 11 and the front face of the cover or the outer or exterior surface of the frontplate component 12, resting on top of the backplate 14 which in turn is resting on top of the underlying electrical wall outlet 11, is less than the depth of a typical electrical plug connected in a traditional manner to the electrical wall outlet 11. Electrical wall outlet 11 is a typical electrical duplex wall outlet, and cover 15 may have less depth than the depth of baseboard molding 21 at the base of the wall 23, as shown in FIG. 1.

For example, a typical electrical plug is at least about an inch wide and when on an electrical cord and inserted into an electrical wall outlet, such as electrical wall outlet 11, such plug and adjacent cord typically protrude or extend outwardly from the outlet a distance of more than an inch and often protrude as much as about two inches to even four inches. In contrast, the cover 15 of the apparatus 10 of the invention when placed over the electrical wall outlet 11 extends outward from the outlet no more than the thickness of the cover 15. Cover 15 is as thin as the thickness of the combination of the frontplate component 12 mounted on the backplate component 14 and the electrical pins 17, 27, 18 and 28, the ground wires 29 and 19, and electrical cords 13 and 16 in between the frontplate component 12 and the backplate component 14. This combined thickness, or thinness, is less than about an inch and also is less than the thickness of a typical baseboard at the base of a wall in preferred embodiments.

Figure 6:
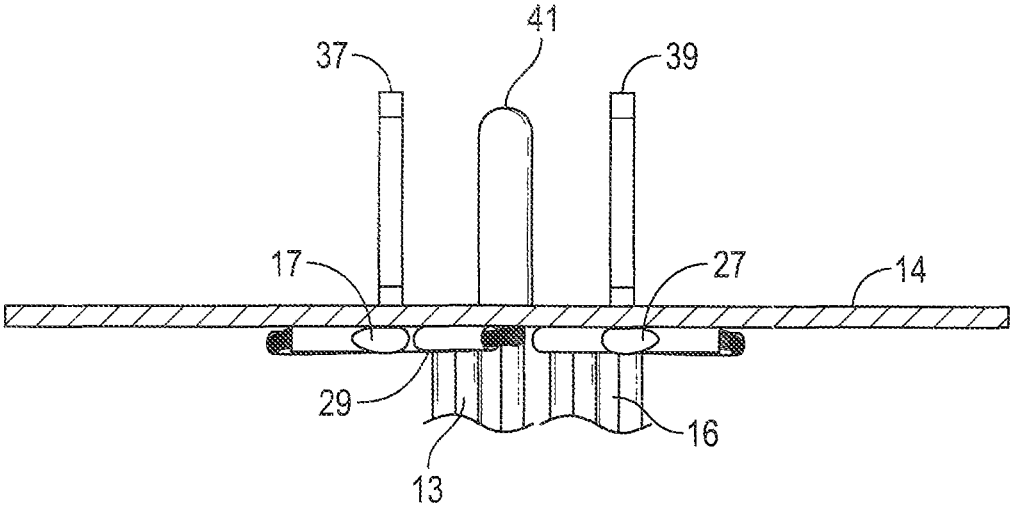
FIG. 6 is a top view of the embodiment of the apparatus of FIG. 1, with uppermost portion cut off along the line shown in FIG. 5 to show the internal portion of the backplate showing the electrical pins of the first electrical connection components as they extend out of the backplate.

As shown in FIGS. 3 and 6, electrical pin 17 is associated with plug prong 37 (neutral), electrical pin 27 (hot) is associated with plug prong 39, and ground wire 29 is associated with plug prong 41 (ground). As shown in FIG. 3, electrical pin 18 is associated with plug prong 20 (neutral), electrical pin 28 (hot) is associated with plug prong 30, and ground wire 19 is associated with ground plug prong 22 (ground). These plug prongs 37, 39, 41, 20, 30 and 22 are like typical electrical plug prongs used in typical wall outlets. Ground plug prongs 41 and 22 are optional.

The conductive electrical pins 17, 27, 18, and 28 and ground wires 29 and 19 respectively corresponding to plug prongs 37, 39, 41, 20, 30 and 22 comprise a configuration of one of about fifteen electrical plug types currently in use, as categorized by the U.S. Department of Commerce International Trade Administration. Other configurations could be used in the invention applying the principals taught herein.

An integral aspect of this embodiment is connection of the electrical pins 17 and 27, through respective plug prongs 37 and 39, to the respective contacts 42 and 44 in the first receptacle 45 of wall outlet 11 as shown in FIG. 2, and connection of the electrical pins 18 and 28, through respective plug prongs 20 and 30, to the respective contacts 33 and 31 in a second receptacle 48 of wall outlet 11 as shown in FIG. 2, without any visible electrical pins 17 or 27, 18 or 28, or visible ground wires 29 or 19, which are all fully concealed under, behind, within, or between the backplate component 14 and the frontplate component 12 mounted to the backplate component 14. Electrical pins 17 and 27 and ground wire 29 comprise the proximal end of electrical cord 13 of the apparatus 10 of the invention. Electrical pins 18 and 28 and ground wire 19 comprise the proximal end of electrical cord 16 of the apparatus 10 of the invention, as shown in FIGS. 5 and 6.

The opposite or distal ends of the electrical cords 13 and 16 have or comprise one or more electrical receptacles or sockets 26 for receiving one or more third-party electrical plugs (not shown) for utility, namely electricity consumption. Such third-party electrical plugs are not part of the invention, but rather are associated with various household and personal devices that require electricity for operation or for battery charging for operation.

The distal ends of electrical cords 13 and 16 can be any shape and have any receptacle or socket configuration that is useful for containing or providing electrical receptacles, such as for nonlimiting example a power strip 43 as shown in FIG. 1 or a power cube (not shown) or include a USB port (not shown), but in most embodiments will be configured to have more than one receptacle 26.

In one embodiment, such receptacles or sockets in the distal ends of electrical cords 13 and 16 are all standard receptacles. In another embodiment, such receptacles or sockets in the distal ends of electrical cords 13 and 16 comprise at least one interchangeable plug for use in different countries or regions, that is North America, South America, Europe, Asia, and Australia. In still another embodiment, such receptacles in the distal ends of electrical cords 13 and 16 also include or comprise one or more USB ports.

In another alternative embodiment, electrical cords 13 and 16 simply end in a single receptacle plug 43. In still another alternative embodiment, power strip 29 comprises a retracting mechanism (not shown) so that cords 13 and/or 16 can be pulled to the exact length needed or desired between the wall outlet 11 and the receptacle(s) 26 at the distal end of electrical cords 13 and/or 16 for utility. Such retracting mechanism would in one embodiment include a catch and release mechanism to hold the cord at the desired length, and to hold the cord tightly at that length so the cord appears neat and unobtrusive along the wall and floor or any other surface it is directed to extend or lay.

Figure 17:
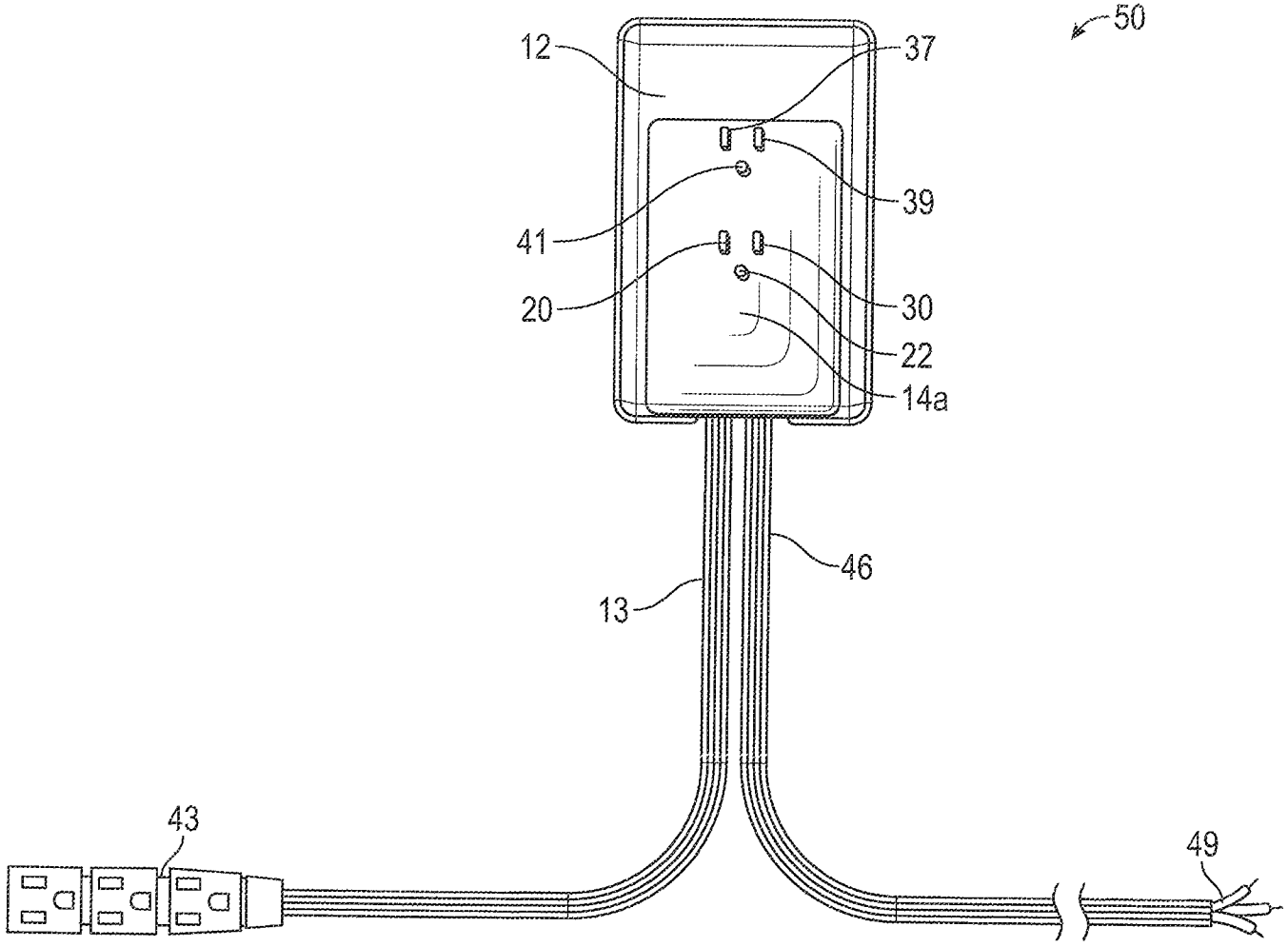
FIG. 17 is a back perspective view (for illustration and not drawn to scale) of a ninth alternative embodiment of the apparatus of the invention, similar to the embodiment shown in FIG. 7 but where the second electrical cord has a distal end prepared for direct connection to a small appliance or electronic device instead of a receptacle at its distal end like the first electrical cord.
Figure 18:
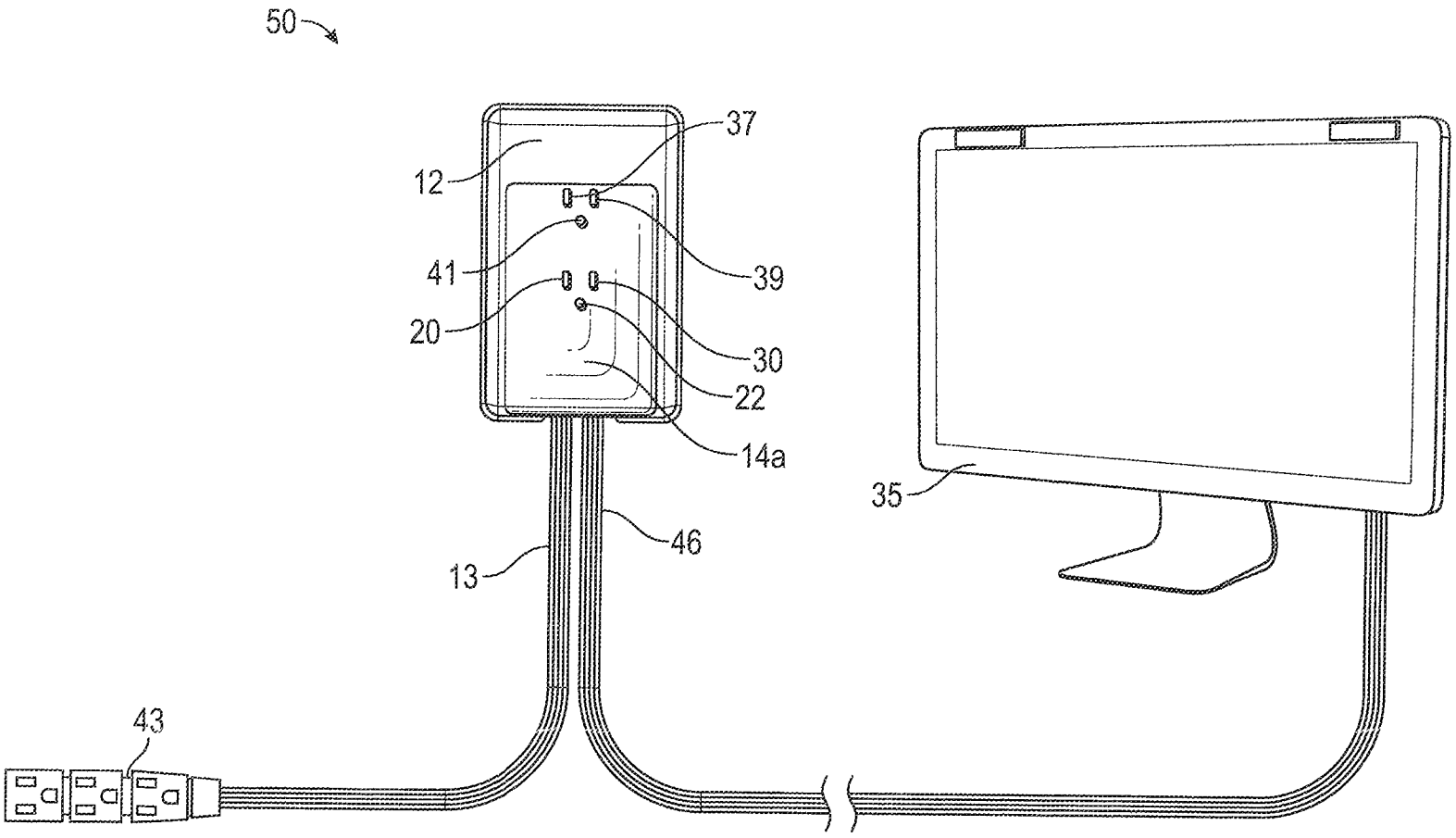
FIG. 18 is another back perspective view (for illustration and not drawn to scale) of the embodiment of FIG. 17 showing an electronic device connected to the distal end of the second electrical cord.

In still another alternative embodiment of the apparatus of the invention, apparatus 50, electrical cord 13 ends in a single receptacle plug 43 but alternative second electrical cord 49 ends in preparation for direct connection to a small appliance or electronic device 35, as shown in FIGS. 17 and 18.

The exact desired length of electrical cords 13 and 16, and 49 will vary depending on the intended use of the invention. Generally, the length is sufficient for electrical cords 13 and 16 or 49 to extend from backplate 14 or cover 15 and be manually guided around any adjacent or nearby furniture and positioned so that the respective distal ends of the electrical cords 13 and 16 of apparatus 10, or of the electrical cords 13 and 49 of apparatus 50, of the invention are conveniently and safely located for use of the receptacles 43 or sockets in said distal ends of cords 13 and 16 or the small appliance or electronic device 35 at the distal end of cord 49. In one embodiment, for example, the distance the cord will extend is selected from a range of about three feet to about thirty feet, although many different variations would work, and longer cords could be used. The length of the cord is generally limited by practical reasons—one does not want a cord so long that excess cord gets in the way of furniture and becomes unsightly or a tripping hazard. The length of cords 13 and 16 can be the same or different. Similarly, the length of cords 13 and 49 can be the same or different. In some embodiments, cord 49 will be shorter than cord 13. As stated above, the present invention advantageously enables furniture to be positioned flush against the wall and in front of a wall outlet covered by the cover 15 of the apparatus of the invention.

As indicated above, through use of electrical cords 13 and 16 or 49, the apparatus of the present invention advantageously eliminates the need to attach electrical plugs of electrical devices directly to the contact openings or receptacles of an electrical wall outlet for use of the outlet. Further, in this aspect, the present invention has an aesthetic benefit with embodiments whereby multiple functional receptacles or sockets are at the distal end of the electrical cord over conventional attachment of multiple cords directly to the outlet. That is, two cords of the apparatus of the invention in such embodiments have the same or equivalent utility or functionality with respect to providing electricity to multiple third party devices as would be typical with multiple cords extending directly from the outlet in traditional or conventional use without the invention. Moreover such utility or functionality of the invention with the two cords can be expanded to different locations, allowing effective use of the first receptacle of the outlet in a different location or direction from use of the second receptacle of the outlet, as the two cords may be positioned in different directions extending from that outlet.

The apparatus of the invention also advantageously can be used with any standard, conventional, or typical indoor electrical duplex wall outlet, without having to make any adjustments or physical changes in the wall outlet. Screws are not needed for attachment of the cover of the apparatus of the invention to the wall outlet for covering the wall outlet and the wall outlet does not need to be replaced with a frontplate particularly designed to fit with the cover of the apparatus of the invention. Rather, the apparatus of the invention and particularly the cover 15 of the apparatus 10 of the invention is held in place over the wall outlet 11 by insertion of prongs 37, 39, 41, 20, 30, and 22, of the apparatus 10 as shown in FIG. 3, in respective receptacles of the wall outlet 11, as indicated in FIG. 2.

Wall outlet 11, as indicated in FIG. 2, is a standard, conventional, or typical indoor electrical duplex wall outlet, which is believed to be commonly called a one-gang electrical wall outlet, and which has two receptacles or sockets, an upper or first and a lower or second receptacle or socket, in vertical alignment with each other. Thus, the apparatus of the invention 10 attaches to such a standard wall outlet 11 having two receptacles or sockets by insertion of the plug prongs 37, 39, 41 of the apparatus of the invention 10 into the first receptacle of the wall outlet, and by insertion of the plug prongs 30, 20, and 22 of the apparatus of the invention 10 into the second receptacle of the wall outlet 11.

Figure 10:
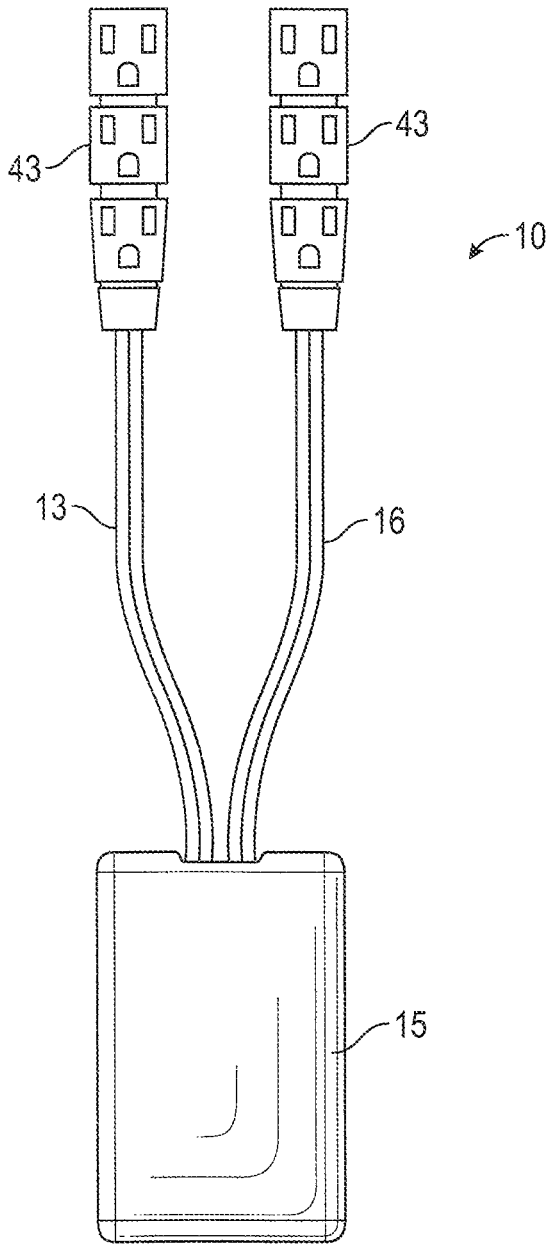
FIG. 10 is a front perspective view (for illustration and not drawn to scale) of a second alternative embodiment of the apparatus of the invention, where an electrical cord from the fifth electrical connection component in the first or top receptacle of the duplex outlet extends from the upper or top end of the cover plate, and the electrical cord from the sixth electrical connection component in the second or bottom receptacle of the duplex outlet also extends from the upper or top end of the cover plate, as shown placed on an electrical duplex outlet (not shown) on a wall as it might typically be used.
Figure 11:
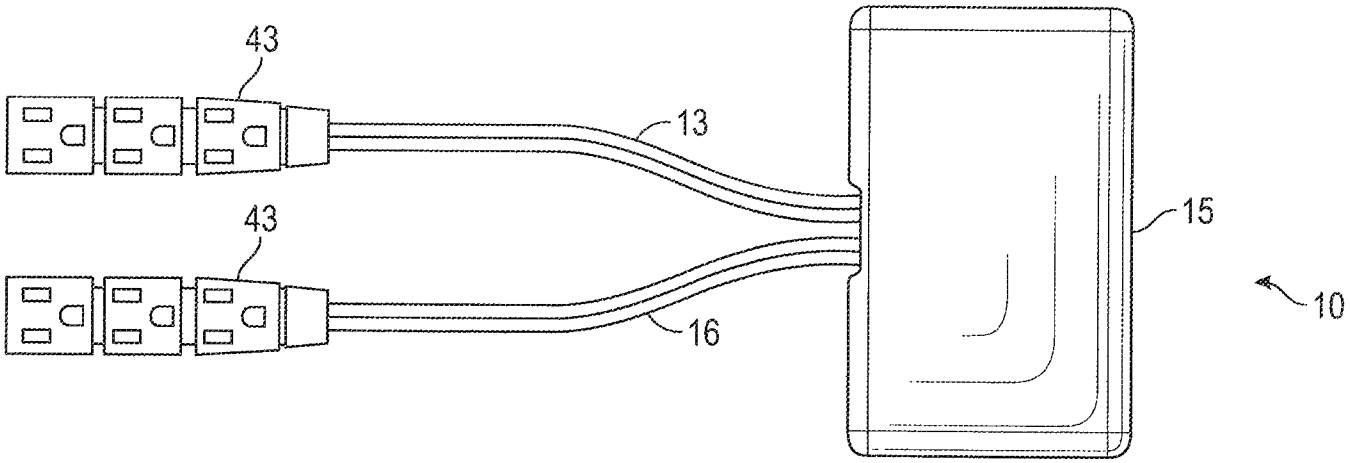
FIG. 11 is a front side perspective view (for illustration and not drawn to scale) of a third alternative embodiment of the apparatus of the invention, where an electrical cord from the seventh electrical connection component in the first or top receptacle of the duplex outlet extends from the left side or west end of the cover plate, and the electrical cord from the eighth electrical connection component in the second or bottom receptacle of the duplex outlet also extends from the left side or west end of the cover plate, as shown placed on an electrical duplex outlet (not shown) on a wall as it might typically be used.
Figure 12:
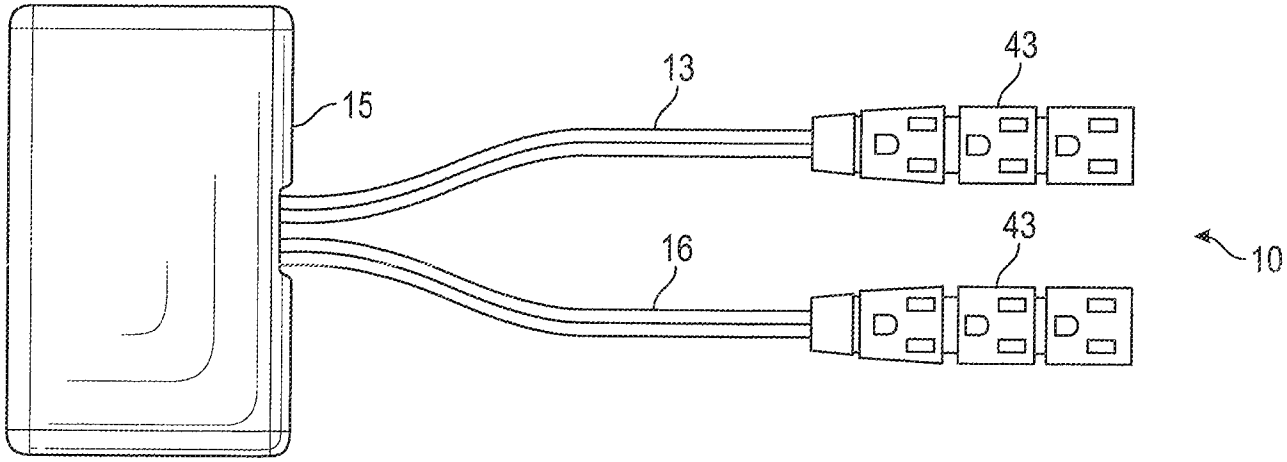
FIG. 12 is a front side perspective view (for illustration and not drawn to scale) of a fourth alternative embodiment of the apparatus of the invention, where an electrical cord from the ninth electrical connection component in the first or top receptacle of the duplex outlet extends from the right side or east end upper or top end of the cover plate, and the electrical cord from the tenth electrical connection component in the second or bottom receptacle of the duplex outlet extends from the right side or east end of the cover plate, as shown placed on an electrical duplex outlet (not shown) on a wall as it might typically be used (for illustration and not drawn to scale).
Figure 13:
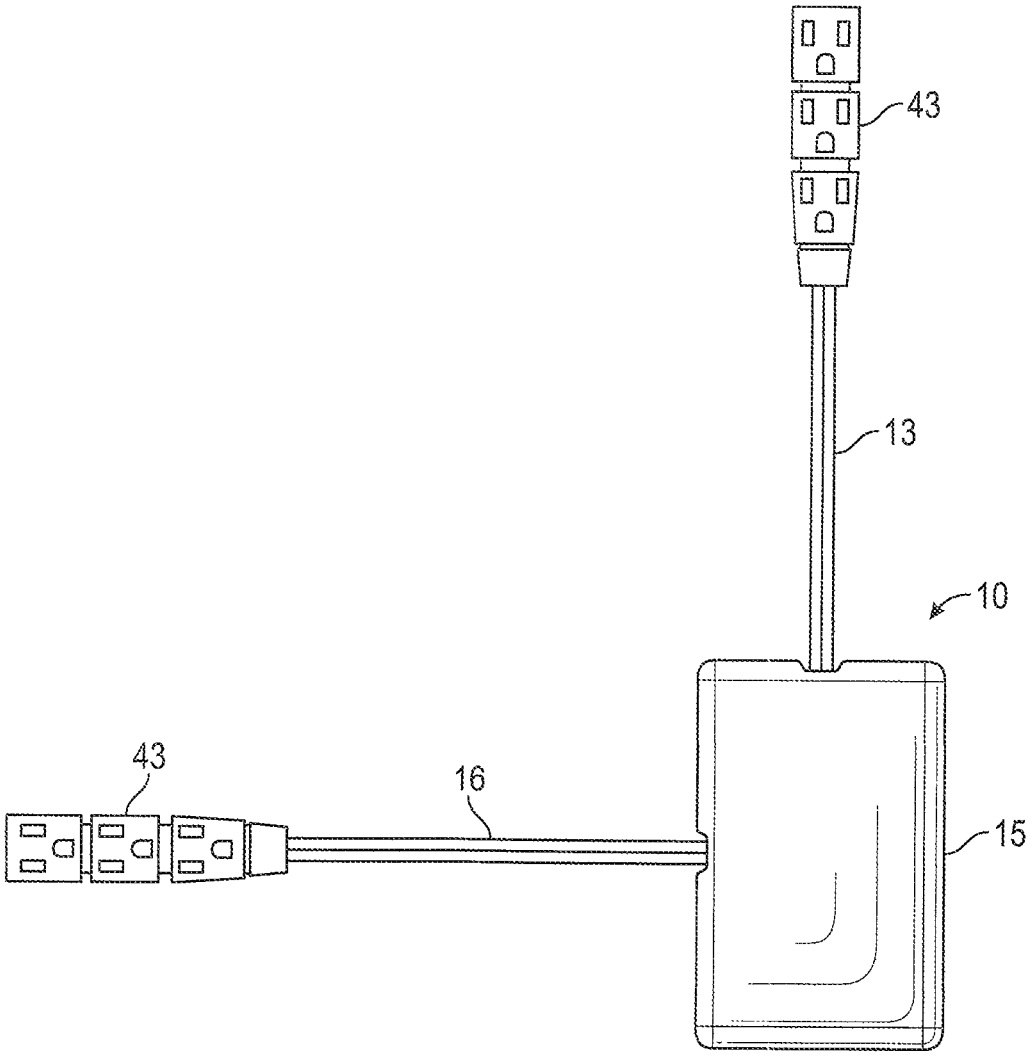
FIG. 13 is a front side perspective view (for illustration and not drawn to scale) of a fifth alternative embodiment of the apparatus of the invention, where an electrical cord from the eleventh electrical connection component in the first or top receptacle of the duplex outlet extends from the upper or top end of the cover plate, and the electrical cord from the twelfth electrical connection component in the second or bottom receptacle of the duplex outlet extends from the left side or west end of the cover plate, as shown placed on an electrical duplex outlet on a wall as it might typically be used.
Figure 14:
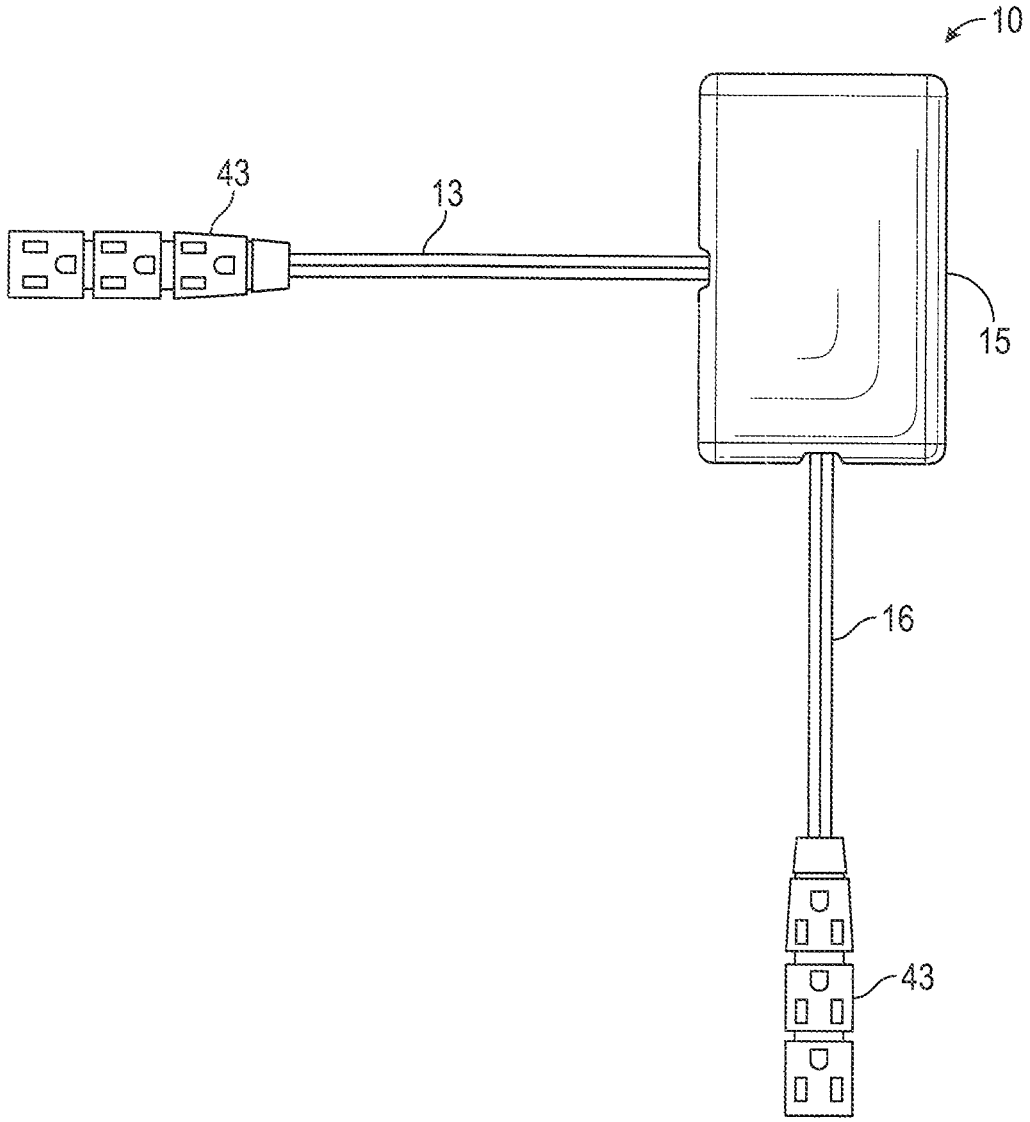
FIG. 14 is a front side perspective view (for illustration and not drawn to scale) of a sixth alternative embodiment of the apparatus of the invention, where an electrical cord from the thirteenth electrical connection component in the first or top receptacle of the duplex outlet extends from the left side or west end of the cover plate, and the electrical cord from the fourteenth electrical connection component in the second or bottom receptacle of the duplex outlet extends from the lower or bottom end of the cover plate, as shown placed on an electrical duplex outlet on a wall as it might typically be used.
Figure 15:
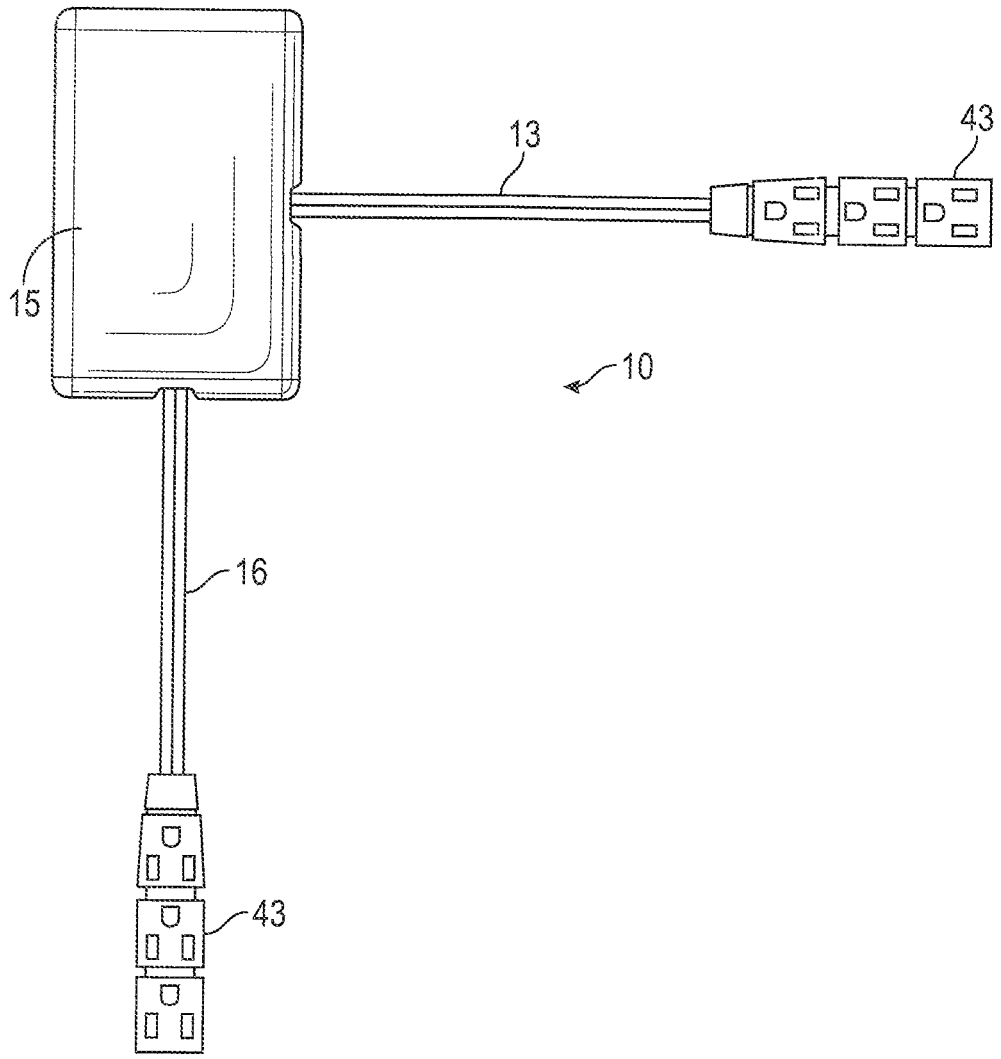
FIG. 15 is a front side perspective view (for illustration and not drawn to scale) of a seventh alternative embodiment of the apparatus of the invention, where an electrical cord from the fifteenth electrical connection component in the first or top receptacle of the duplex outlet extends from the right side or east end of the cover plate, and the electrical cord from the sixteenth electrical connection component in the second or bottom receptacle of the duplex outlet extends from the lower or bottom end of the cover plate, as shown placed on an electrical duplex outlet on a wall as it might typically be used.
Figure 16:
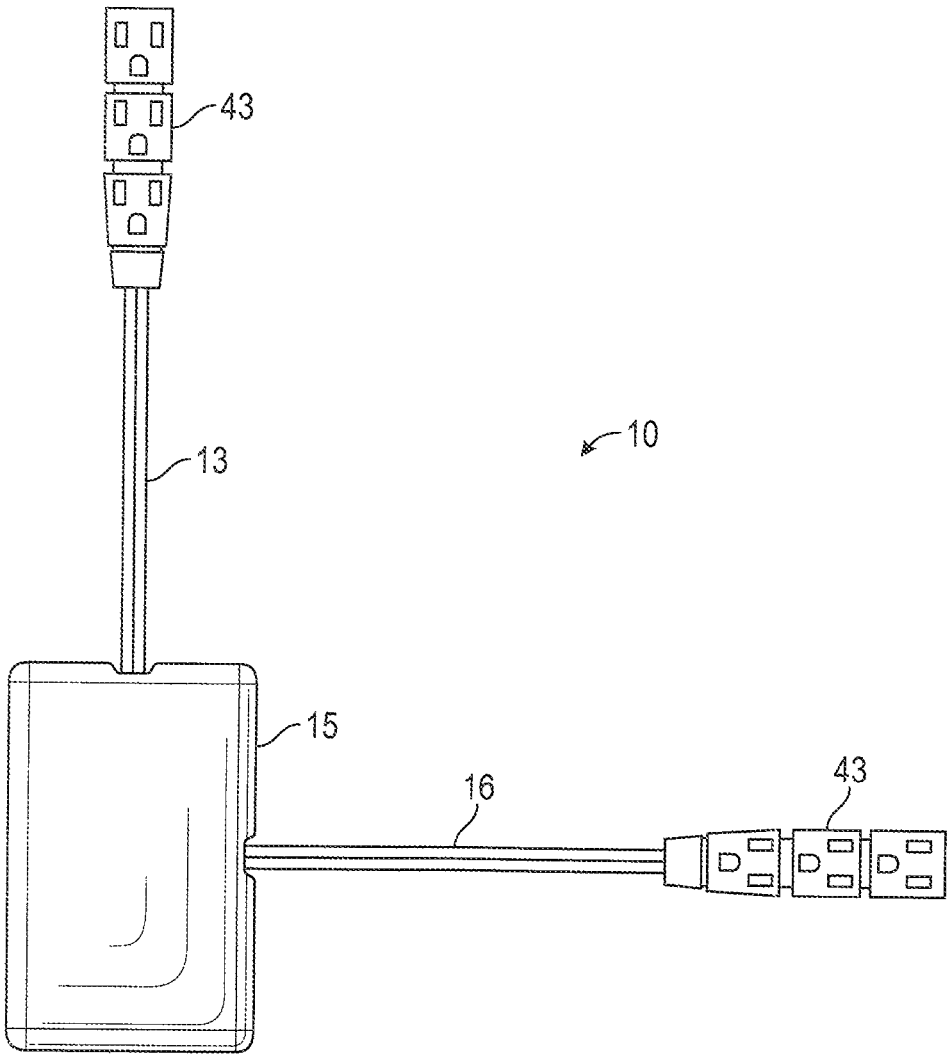
FIG. 16 is a front side perspective view (for illustration and not drawn to scale) of an eighth alternative embodiment of the apparatus of the invention, where an electrical cord from the seventeenth electrical connection component in the first or top receptacle of the duplex outlet extends from the upper or top end of the cover plate, and the electrical cord from the eighteenth electrical connection component in the second or bottom receptacle of the duplex outlet extends from the right side or east end of the cover plate, as shown placed on an electrical duplex outlet on a wall as it might typically be used.

In one embodiment, the apparatus of the invention 10 or 50 could be similarly used with a standard electrical duplex wall outlet having two receptacles or sockets aligned in a horizontal position. In such case in one embodiment, electrical cords 13 and 16 or 49 would extend from one side of the cover 15, rather than the base of the cover 15 as shown in FIG. 1, or could be adapted (i.e., moved) to extend from the base of the cover in the horizontal position. In other embodiments of the invention, as shown in FIGS. 10 through 12, the apparatus of the invention 10 could be configured for use in the vertical position as shown in FIG. 2 but with the electrical cords 13 and 16 extending from the right or left side of cover 15. Apparatus 50 could also be configured for use in the vertical position with electrical cords 13 and 49 extending form the right or left side of cover 15, just as illustrated for apparatus 10 in FIGS. 10 through 12. In still other embodiments of the invention, as shown in FIGS. 9 and 14 through 16, the cover 15 could be adapted so that the electrical cords 13 and 16 (or 49) extend from different sides of the cover 15. In such different embodiments, the configuration of the electrical components are substantially like the configurations shown in FIG. 5 for the first and second electrical components, as one of ordinary skill would appreciate from the teachings herein, with the ninety degree angles maintained and the routing or arrangement of the electrical cords such that they exit the cover or backplate from the desired sides of the cover 15 without interfering with one another and without adding thickness or bulk to the cover.

The apparatus of the present invention can also be adapted for standard, conventional, or typical multi-gang outlets, such as for nonlimiting example, double or triple duplex wall outlets. Such outlets tend to simply be double, triple, quadruple, or other multiple versions of a duplex outlet and thus respectively have four, six, eight, or other multiple receptacles or sockets typically aligned in pairs. Thus the apparatus of the invention would be expanded to accommodate four, six, eight, or other multiple pairs of electrical plugs for insertion into the corresponding outlet receptacles or sockets. For another example, in one such alternative embodiment, the multi-gang electrical outlet is sized to support up to about sixteen receptacles or sockets, normally allowing attachment or insertion into the multi-gang electrical outlet as many as sixteen electrical receptacles, or an apparatus of the invention with 32 plug prongs or 38 plug prongs including the ground prongs in the count.

In such alternative embodiments of the invention not shown for use in multi-gang outlets, the backplate component of the cover of the apparatus of the invention is sized to align and position over such a standard indoor multi-gang electrical wall outlet. The frontplate component is sized to align and position over and curve slightly around the perimeter edge of the backplate component for a tight fit as described above that preferably requires no adhesive or screws to stay in place.

To add to the aesthetics of the cover 15 of the invention, in one embodiment at least the front or exterior of the frontplate is painted or is covered in wallpaper.

The present invention has been illustrated with electrical plugs and receptacles having shapes that are commonly used in the United States of America. However, it is known that different shaped electrical plug prongs and receptacles are used in different countries and the present invention may readily be adapted for those different shapes.

While preferred embodiments of the present disclosure have been described, it should be understood that other various changes, adaptations and modifications can be made therein without departing from the spirit of the invention(s) and the scope of the appended claims. The scope of the present disclosure should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

What is claimed is:

1. An apparatus for hiding a standard indoor electrical duplex wall outlet having a first receptacle and a second receptacle while affording continued use of both of said receptacles, the apparatus comprising:

a. a cover having a top side, bottom side, left side and a right side, and a front and a back comprising:
   (i) a frontplate;
   (ii) a backplate comprising a first set of electrical prongs including a hot prong, a neutral prong, and optionally a ground prong, positioned to correspond to the first receptacle of the wall outlet; and a second set of electrical prongs including a hot prong, a neutral prong, and optionally a ground prong, positioned to correspond to the second receptacle of the wall outlet; and b. a first electrical cord extending from the backplate, or the cover, said first electrical cord comprising at the cord's proximal end: at least one hot pin, at least one neutral pin and optionally a ground wire positioned on or fastened or attached to the backplate of the cover in such manner as to minimize distance between the frontplate and the backplate, and respectively connected to or associated with the first set of electrical prongs including a hot prong, neutral prong and any ground prong on the exterior of the backplate, and comprising at the cord's distal end at least one receptacle;

c. a second electrical cord extending from the backplate, or the cover, said second electrical cord comprising at the cord's proximal end: at least one hot pin, at least one neutral pin and optionally a ground wire positioned on or fastened or attached to the backplate of the cover in such manner as to minimize distance between the frontplate and the backplate, and respectively connected to or associated with the second set of electrical prongs including a hot prong, neutral prong and any ground prong on the exterior of the backplate, and comprising at the cord's distal end at least one receptacle or preparation for direct connection to a small appliance or electronic device;

wherein the first set of electrical prongs and the second set of electrical prongs are positioned one with respect to the other so as not to interfere with the function of one or the other, and so as not to add bulk to the cover; and wherein the first electrical cord and the second electrical cord can extend from the backplate or cover at the same or different sides of the cover and in the same or different directions.

2. The apparatus of claim 1 wherein the hot pins and the neutral pins of the first and second sets of electrical prongs are positioned at ninety degree angles to the backplate so as not to add bulk to the cover.

3. The apparatus of claim 1 wherein the height of the first set of electrical prongs and the second set of electrical prongs is approximately the same or less than the thickness of the first and second electrical cords.

4. The apparatus of claim 1 wherein the backplate fits inside the frontplate and the backplate and the frontplate hold together without fasteners, attachers, or adhesive.

5. The apparatus of claim 1 wherein the frontplate has perimeter edges and the backplate has outer edges and the perimeter edges of the frontplate curves over the outer edges of the backplate.

6. The apparatus of claim 1 wherein the frontplate has curved perimeter edges and the backplate has outer edges smaller than the perimeter edges of the frontplate such that the backplate fits entirely within the perimeter edges of the frontplate.

7. The apparatus of claim 1 wherein the cover has a shape mimicking the wall outlet but sufficiently larger to completely cover the wall outlet when held on or over the wall outlet by insertion of the first and second sets of electrical prongs into the respective first and second receptacles of the wall outlet.

8. The apparatus of claim 1 wherein the cover is held on or over the wall outlet by insertion of the first and second sets of electrical prongs into the respective first and second receptacles of the wall outlet and the cover does not extend outwardly from the wall outlet more than about an inch.

9. The apparatus cover of claim 1 wherein the frontplate has a blank exterior surface with no apertures.

10. The apparatus of claim 9 wherein the frontplate has an exterior surface painted or covered with fabric or wallpaper.

11. The apparatus of claim 1 wherein at least one side of the frontplate or backplate has, or one side of the frontplate and backplate together have, or form, at least one hole or slot and the first and second electrical cords respectively extend from said at least one hole or slot.

12. The apparatus of claim 1 wherein at least the first or the second electrical cord further comprises at its distal end at least one USB port.

13. The apparatus of claim 1 wherein at least the first or the second electrical cord is retractable at its distal end.

14. The apparatus of claim 1 wherein the distance that the first and second cords extend from the cover is an amount selected for each of said first and second cords from the range of about three feet to about thirty feet.

15. The apparatus of claim 1 wherein the first and second electrical cords both extend from the bottom side or the top side of the cover.

16. The apparatus of claim 1 wherein the first electrical cord extends from the top side of the cover and the second electrical cord extends from the bottom side of the cover.

17. The apparatus of claim 1 wherein the first electrical cord extends from the top or bottom side of the cover and the second electrical cord extends from the left or right side of the cover.

18. A functional indoor electrical wall outlet cover for hiding a standard indoor electrical duplex wall outlet having a first receptacle and a second receptacle while affording continued use of said first and second receptacles, the apparatus comprising:

a. a frontplate of the cover;

b. a backplate of the cover comprising:

(i) a first set of electrical prongs including a first hot prong, a first neutral prong, and a first ground prong, positioned to correspond to a first receptacle of the wall outlet; and (ii) a second set of electrical prongs including a second hot prong, a second neutral prong, and a second ground prong, positioned to correspond to the second receptacle of the wall outlet;

c. a first electrical cord extending from the backplate or the cover, said first electrical cord comprising:

(i) at the first electrical cord's proximal end: at least a first hot pin, at least a first neutral pin and a first ground wire positioned at right angles on the backplate of the cover in such manner as to minimize the distance between the frontplate and the backplate so that said distance does not exceed the thickness of the first electrical cord, and said first hot pin, first neutral pin and first ground wire are respectively connected to or associated with the first hot prong, first neutral prong and first ground prong on the exterior of the backplate;

(ii) at the first electrical cord's distal end: at least one, third receptacle;

(iii) at the second electrical cord's proximal end: at least a second hot pin, at least a second neutral pin and a second ground wire positioned at right angles on the backplate of the cover in such manner as to minimize the distance between the frontplate and the backplate so that said distance does not exceed the thickness of the second electrical cord, and said second hot pin, second neutral pin and second ground wire are respectively connected to or associated with the second hot prong, second neutral prong and second ground prong on the exterior of the backplate; and;

(iv) at the second electrical cord's distal end: at least one, fourth receptacle or preparation for direct connection to a small appliance or an electronic device.

19. The apparatus of claim 16 wherein the frontplate has perimeter edges and the backplate has outer edges and the perimeter edges of the frontplate curve over the outer edges of the backplate, such that the backplate fits inside the frontplate, and the backplate and the frontplate hold together without fasteners, attachers, or adhesive.

20. The apparatus of claim 16 wherein the cover has a shape mimicking the wall outlet but sufficiently larger to completely cover the wall outlet when held on or over the wall outlet by insertion of the set of electrical prongs and the non-conductive prongs into the respective first and second receptacles of the wall outlet; and wherein when so held the cover does not extend outwardly from the wall outlet more than about one inch.

21. The apparatus of claim 16 wherein the backplate fits inside the frontplate and the backplate and the frontplate hold together without fasteners, attachers, or adhesive.

22. The apparatus of claim 18 wherein the cover is held on or over the wall outlet by insertion of the first set of electrical prongs and the second set of electrical prongs into the respective first and second receptacles of the wall outlet and the cover when so held does not extend outwardly from the wall outlet more than about an inch.

* * * * *